US005131521A

United States Patent [19]

Johnson et al.

[11] Patent Number: 5,131,521

[45] Date of Patent: Jul. 21, 1992

[54] MOVING HANDRAIL DRIVE

[75] Inventors: Gerald E. Johnson, Farmington; James A. Rivera, Bristol; Frank M. Sansevero, Farmington; Dat Nguyen, New Britain, all of Conn.

[73] Assignee: Otis Elevator Company, Farmington, Conn.

[21] Appl. No.: 756,391

[22] Filed: Sep. 9, 1991

[51] Int. Cl.[5] ..... B66B 23/22

[52] U.S. Cl. ..... 198/335; 198/331

[58] Field of Search ..... 198/331, 335

[56] References Cited

U.S. PATENT DOCUMENTS

| | | | |
|---|---|---|---|
| 3,653,484 | 4/1972 | Taylor | 198/335 |
| 4,901,839 | 2/1990 | Johnson et al. | 198/335 |
| 4,998,613 | 3/1991 | Rivera | 198/335 |
| 5,018,616 | 4/1991 | Johnson | 198/335 |
| 5,062,520 | 11/1991 | Nguyen et al. | 198/335 |

*Primary Examiner*—Joseph E. Valenza

*Attorney, Agent, or Firm*—William W. Jones

[57] ABSTRACT

A moving handrail on an escalator or the like is driven by pairs of rollers which form a nip through which the handrail moves. The rollers are eccentrically mounted so as to automatically tighten the nip in response to resistance to movement of the handrail. The roller or rollers which contact the underside of the handrail are rotatably driven by power sprockets, while the roller or rollers contacting the outer or exposed surface of the handrail are idler rollers which are not rotated by the power sprockets so as to lessen scuffing of the exposed surface of the handrail by the rollers.

4 Claims, 1 Drawing Sheet

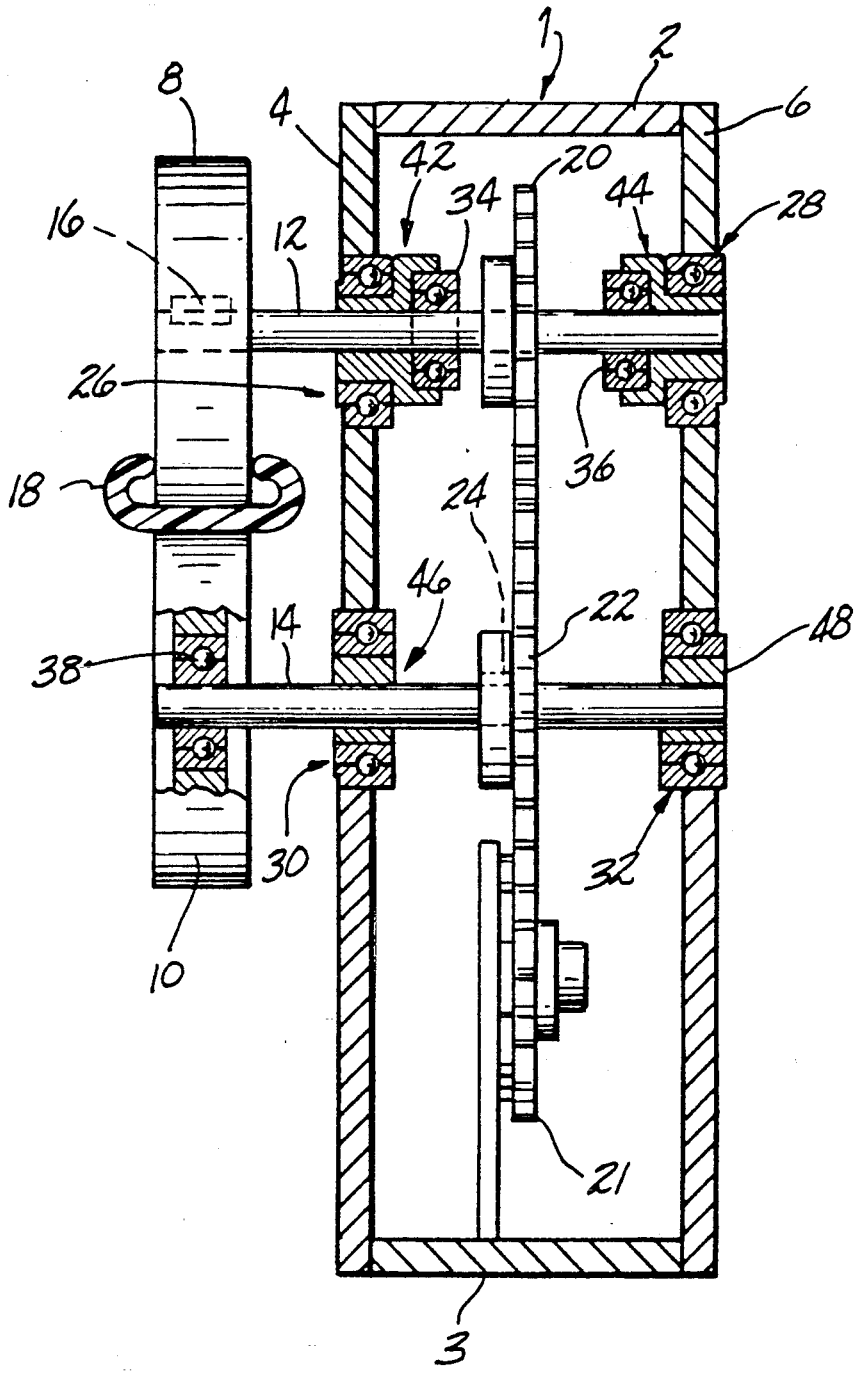
1
2
8
4
6
42
20
34
44
28
16
12
26
36
18
24
46
22
14
48
38
30
32
10
21
3

MOVING HANDRAIL DRIVE

DESCRIPTION

1. Technical Field

This invention relates to a self adjustable moving handrail drive which includes an idler roller in each pair of nip rollers. More particularly, this invention relates to a handrail drive for use with an escalator or moving walkway, which drive will not damage the visible surface of the handrail.

2. Background Art

U.S. Pat. Nos. 4,998,613 granted Mar. 12, 1991, and 5,018,616 granted May 28, 1991, both to Gerald E. Johnson and James A. Rivera disclose embodiments of a handrail drive for escalators and moving walkways, which handrail drive includes an automatic tightening feature. The handrail drive includes one or more pairs of drive rollers which form a nip through which handrail passes along its return path of travel on the escalator or the like. The rollers are connected on common shafts to drive sprockets on which a powered drive chain is entrained. The shafts are mounted to eccentric bushings disposed in bearings which have axes of rotation which are not concentric with the axis of rotation of the roller shafts. The rollers will thus automatically tighten down on the handrail whenever more force is needed to move the handrail due to increased drag on the handrail. This condition could result from increased friction in the system, or from increased passenger load retarding handrail movement. One problem that has been observed when excessive driving forces are applied to the handrail is scuffing of the outer surface of the handrail by the drive rollers. Such scuffing is undesirable from an aesthetic viewpoint, and it also shortens the useful life of the handrail.

DISCLOSURE OF THE INVENTION

This invention relates to a self adjusting moving handrail drive which will automatically increase the pressure applied to the handrail as described above, but will not scuff the exposed surface of the handrail in cases when higher than normal pressure is applied to the handrail. In the handrail drive of this invention, only the roller that contacts the underside of the handrail is a drive roller, i.e., is directly connected to and rotated by the power chain and sprocket. In the drive assembly of this invention the power chain and sprockets influence the eccentric mounts of both of the roller shafts so that both roller shafts will move toward the handrail when resistance to movement of the handrail increases. The handrail scuffing is avoided by converting the roller which engages the outer surface of the handrail from a drive roller to an idler roller. This is accomplished by mounting the idler roller on its shaft on a ball bearing mount so that the force needed to rotate the idler roller is derived from the handrail, and not from the drive sprocket shaft. Thus, the idler roller will tighten against the handrail but will not apply a driving force to it. The idler roller cannot therefore scuff the handrail.

It is therefore an object of this invention to provide a self-tightening moving handrail drive for use in an escalator or moving walkway.

It is a further object of this invention to provide a handrail drive of the character described which automatically increases driving pressure on the handrail in response to increased resistance to handrail movement.

It is another object of this invention to provide a handrail drive of the character described which prevents scuffing of an exposed surface of the handrail.

These and other objects and advantages of the invention will become more readily apparent from the following detailed description of a preferred embodiment thereof, when taken in conjunction with the accompanying drawings, in which:

BRIEF DESCRIPTION OF THE DRAWINGS

The drawing is a sectional view of the mechanism showing the eccentricity of the roller and sprocket shafts, and the shaft mount bearings.

BEST MODE FOR CARRYING OUT THE INVENTION

Referring now to the drawing the housing for the drive mechanism is denoted by the numeral 1, and includes opposed side walls 4 and 6, a top wall 2, and a bottom wall 3. Rollers 8 and 10 are mounted on shafts 12 and 14, respectively, and the drive roller 8 is keyed to the shaft 12 by key 16. The rollers 8 and 10 combine to form a nip through which the handrail 18 passes. Chain sprockets 20 and 22 are secured by keys 24 (only one of which is shown) to the shafts 12 and 14, respectively. Bearings 26 and 28 are mounted in the housing walls 4 and 6, as are bearings 30 and 32. Shaft bearings 34 and 36 are mounted on the shaft 12. Bushing 42 interconnects bearings 26 and 34 and similarly bushing 44 interconnects bearings 28 and 36. As a result, the shaft 12 rotates in the bushings 42 and 44. Additionally, bushings 44 and 44 can rotate within the housing walls 4 and 6 by virtue of the bearings 26 and 28.

The roller 10 is mounted on the shaft 14 by means of an annular bearing 38 whereby the roller 10 rotates independently of the shaft 14. The rotation of the shaft 14 thus cannot impart any driving force to the roller 10, but it can cause rotation of the bearings 30 and 32 to tighten the roller 10 against the exposed surface of the handrail 18. This mounting arrangement ensures that the roller 10 is driven by the handrail 18, and not vice-versa. Scuffing of the handrail 18 by the roller 10 will thus be avoided.

Since many changes and variations of the disclosed embodiment of the invention may be made without departing from the inventive concept, it is not intended to limit the invention otherwise than as required by the appended claims.

What is claimed is:

1. A handrail drive assembly for a moving handrail, said assembly comprising:

a) a pair of rollers mounted on rotatable roller shafts, said rollers forming a nip through which the handrail passes;

b) rotatable end bearings supporting said roller shafts, said end bearings being mounted eccentrically of said roller shafts;

c) drive means for rotating said roller shafts in said end bearings whereby the axes of said rollers move toward each other due to the eccentricity of said shafts and bearings to increase nip pressure on the handrail responsive to resistance to movement of the handrail;

d) key means connecting one of said rollers to its roller shaft whereby said one roller is positively rotated by its roller shaft; and e) idler means connecting the other of said rollers in said pair to its other roller shaft whereby said other roller rotates independently of its other roller shaft.

2. The handrail drive assembly of claim 1 wherein said one roller engages an undersurface of the handrail, and said other roller engages an outer surface of the handrail.

3. The handrail drive assembly of claim 1 wherein said idler means is a bearing mounting said other roller on its roller shaft.

4. The handrail drive assembly of claim 3 wherein said bearing is a ring bearing.

* * * * *